US007361128B2

(12) United States Patent
Chen

(10) Patent No.: US 7,361,128 B2
(45) Date of Patent: Apr. 22, 2008

(54) EXERCISING APPARATUS

(76) Inventor: Chih-Liang Chen, No. 66, Alley 71, Lane 252, Sec. 2, Jieshou Rd., Pateh City, Taoyuan Hsien (TW)

( * ) Notice: Subject to any disclaimer, the term of this patent is extended or adjusted under 35 U.S.C. 154(b) by 64 days.

(21) Appl. No.: 11/475,012

(22) Filed: Jun. 27, 2006

(65) Prior Publication Data

US 2007/0298948 A1 Dec. 27, 2007

(51) Int. Cl.
*A63B 26/00* (2006.01)

(52) U.S. Cl. ..... 482/144; 482/142; 482/143; 482/145

(58) Field of Classification Search ..... 297/83, 297/84, 325, 327; 482/39, 66, 95, 96, 100, 482/135, 138, 140, 142, 143, 144, 145, 148; *A63B 26/00*
See application file for complete search history.

(56) References Cited

U.S. PATENT DOCUMENTS 1,693,810 A * 12/1928 Meville et al. ..... 606/242
3,286,708 A * 11/1966 Gartner ..... 601/5
3,716,230 A * 2/1973 Wang ..... 482/142
4,072,341 A * 2/1978 Kurz ..... 297/27
4,232,662 A * 11/1980 Barber ..... 482/144
4,254,949 A * 3/1981 Brentham ..... 482/112
D263,978 S * 4/1982 Brentham ..... D21/676
4,410,176 A * 10/1983 Miller ..... 482/144
4,419,989 A * 12/1983 Herbold ..... 606/242
4,438,761 A * 3/1984 McGowen ..... 482/144
4,444,178 A * 4/1984 Kuo ..... 482/144
4,494,532 A * 1/1985 Masuda et al. ..... 482/38
4,502,682 A * 3/1985 Miller ..... 482/144
4,531,731 A * 7/1985 Law ..... 482/144
4,534,554 A * 8/1985 Miller ..... 482/144
4,534,555 A * 8/1985 McGowen ..... 482/144
4,546,972 A * 10/1985 Goyer ..... 482/144
4,672,697 A * 6/1987 Schurch ..... 5/610
4,717,148 A * 1/1988 Brewer ..... 482/144
4,792,181 A * 12/1988 Guichon ..... 297/28
4,867,143 A * 9/1989 Morin ..... 606/244
5,044,358 A * 9/1991 Morin ..... 606/241
5,334,123 A * 8/1994 Rutherford ..... 482/144
5,348,367 A * 9/1994 Mizelle ..... 297/83
5,551,937 A * 9/1996 Kwo ..... 482/144
5,575,745 A * 11/1996 Lin ..... 482/144

(Continued)

FOREIGN PATENT DOCUMENTS

JP 58000428 A * 1/1983

*Primary Examiner*—Joseph S. Del Sole
*Assistant Examiner*—Daniel F Roland
(74) *Attorney, Agent, or Firm*—Hershkovitz & Associates, LLC; Abe Hershkovitz

(57) ABSTRACT

An exercising apparatus has a front frame, a rear frame and a seat assembly. The rear frame is connected to the front frame and the seat assembly is mounted pivotally between the front frame and the rear frame. The seat assembly has a seat back, a seat, a leg holder, a front connecting rod and a lower connecting rod. When a user is in an inverted position, the user's body is stretched and pressure on the spine can be eliminated. With the relative movement between the seat back and the seat and the relative movement between the seat and the leg holder, the torso and femoral muscles of the user can be fully exercised.

9 Claims, 6 Drawing Sheets

U.S. PATENT DOCUMENTS 5,580,340 A * 12/1996 Yu ..... 482/96
5,616,106 A * 4/1997 Abelbeck ..... 482/96
5,665,042 A * 9/1997 Breaux ..... 482/142
5,669,865 A * 9/1997 Gordon ..... 482/142
5,681,250 A * 10/1997 Hoover et al. ..... 482/142
5,718,660 A * 2/1998 Chen ..... 482/144
5,868,461 A * 2/1999 Brotherston ..... 297/84
5,967,956 A * 10/1999 Teeter ..... 482/144
6,030,325 A * 2/2000 Ottoson et al. ..... 482/144
6,135,930 A * 10/2000 Kuo ..... 482/72
6,149,560 A * 11/2000 Kim ..... 482/145
6,344,017 B1 * 2/2002 Teeter ..... 482/144
6,679,818 B2 * 1/2004 Hsien ..... 482/144
6,742,206 B1 * 6/2004 Han ..... 5/618
6,811,522 B1 * 11/2004 McQuinn ..... 482/143
6,814,691 B1 * 11/2004 Kuo ..... 482/145
7,011,362 B1 * 3/2006 Huang ..... 297/89
7,025,415 B1 * 4/2006 Wu ..... 297/119
7,063,652 B1 * 6/2006 Teeter et al. ..... 482/145
7,066,868 B2 * 6/2006 Van Den Heever ..... 482/142
7,081,073 B1 * 7/2006 Smith ..... 482/145
D528,614 S * 9/2006 McVay et al. ..... D21/687
7,112,167 B2 * 9/2006 Kim ..... 482/145
7,118,518 B1 * 10/2006 Teeter ..... 482/144
7,125,372 B1 * 10/2006 Teeter et al. ..... 482/144
7,125,389 B2 * 10/2006 Sin ..... 601/98
7,160,233 B2 * 1/2007 Perez ..... 482/140
2003/0162639 A1 * 8/2003 Hsien ..... 482/144
2003/0216231 A1 * 11/2003 Reitz et al. ..... 482/142
2004/0063555 A1 * 4/2004 Perez ..... 482/140
2004/0157713 A1 * 8/2004 Kweon ..... 482/144
2005/0187084 A1 * 8/2005 Tornabene ..... 482/140
2005/0266973 A1 * 12/2005 Chen ..... 482/142
2006/0030466 A1 * 2/2006 Chen ..... 482/145
2006/0035773 A1 * 2/2006 Kim ..... 482/145
2006/0234845 A1 * 10/2006 Teeter et al. ..... 482/145
2007/0161477 A1 * 7/2007 Wang ..... 482/144

* cited by examiner

EXERCISING APPARATUS

BACKGROUND OF THE INVENTION

1. Field of Invention

The present invention relates to an exercising apparatus, and more particularly to an exercising apparatus that is provided for inverting a user and exercising the use's torso and femoral muscles.

2. Description of the Related Art

Discs of the spine separate vertebrae, allow vertebrae's movement and provide a shock absorbing effect. Nerves in the body leave the spine through the spaces between the vertebrae. Pressure of body weight on the discs and constant pounding from running can cause the discs to be compressed. The pressure on the nerves and discs may cause a frequent back pain and this is a big problem in daily life.

Inversion therapy involves hanging upside down to apply gentle traction to the spine. This increases the space between the vertebrae and reduces the pressure applied on the discs. Increasing the space between the vertebrae reduces the pressure on the nerves and discs, which means eliminating back pain. In addition, appropriate exercises of torso muscles can increase support to the spine and is also helpful to ease back pain.

A conventional inversion table comprises a frame and a table. The frame has two handgrips mounted on both side of the frame. The table is supported by the frame above the ground for pivotal movement about a horizontal axis and has an ankle clamp mounted on one end of the table. In use, a user lies on the table and fixes his ankle with the ankle clamp. Then the user pivots the table about the horizontal axis by griping the handgrips to an inverted position. However, the user's body is kept in a flat position and the torso muscles of the user are not used for inverting the user. Thus the conventional inversion table cannot provide any exercising effect to the user.

To overcome the shortcomings, the present invention provides an exercising apparatus to mitigate or obviate the aforementioned problems.

SUMMARY OF THE INVENTION

The primary objective of the present invention is to provide an exercising apparatus such that a user can pivot from a sitting position to an inverted position and exercise the torso muscles of the user.

The exercising apparatus in accordance with the present invention comprises a front frame, a rear frame and a seat assembly.

The front frame has a damper mounted on the front frame.

The rear frame is connected to the front frame and has two hanging members and two handgrips. The hanging members and handgrips are mounted on the rear frame.

The seat assembly is mounted pivotally between the front frame and the rear frame and has a seat back, a seat, a leg holder, a front connecting rod and a lower connecting rod. The seat back is mounted pivotally between the hanging members and has a lower end. The seat is mounted pivotally on the lower end of the seat back and has a front end.

The leg holder is mounted pivotally on the front end of the seat, aligns with the damper and has a lower end and two holding bars. The holding bars are mounted on the lower end of the leg holder. The front connecting rod is mounted pivotally on the front end of the seat and has two ends. The ends are mounted on the rear frame. The lower connecting rod has a front end and a rear end. The front end is connected pivotally to the leg holder and the rear end is connected pivotally to the lower end of the seat back.

Other objectives, advantages and novel features of the invention will become more apparent from the following detailed description when taken in conjunction with the accompanying drawings.

DETAILED DESCRIPTION OF THE INVENTION

Figure 1:
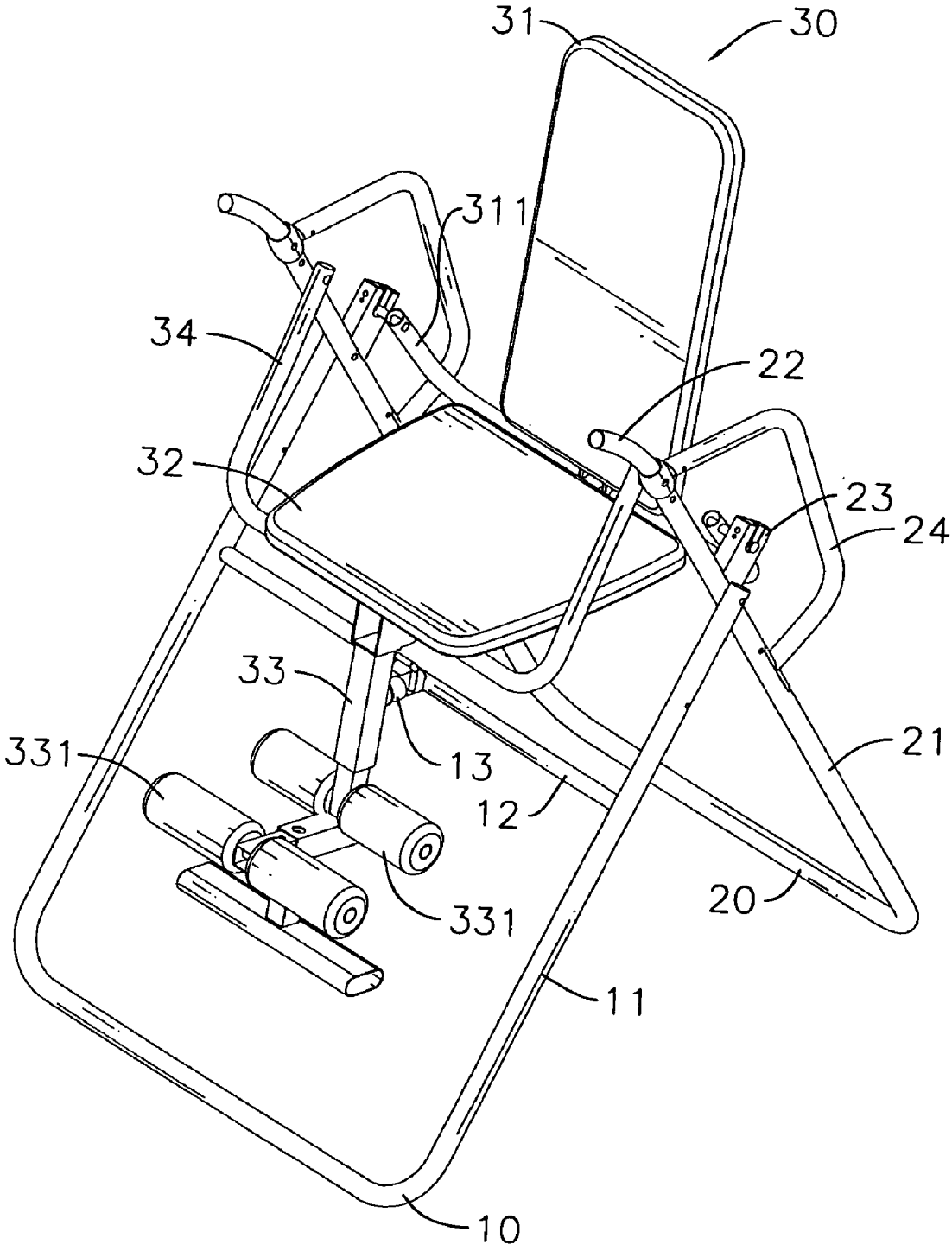
FIG. 1 is a perspective view of an exercising apparatus in accordance with the present invention.
Figure 2:
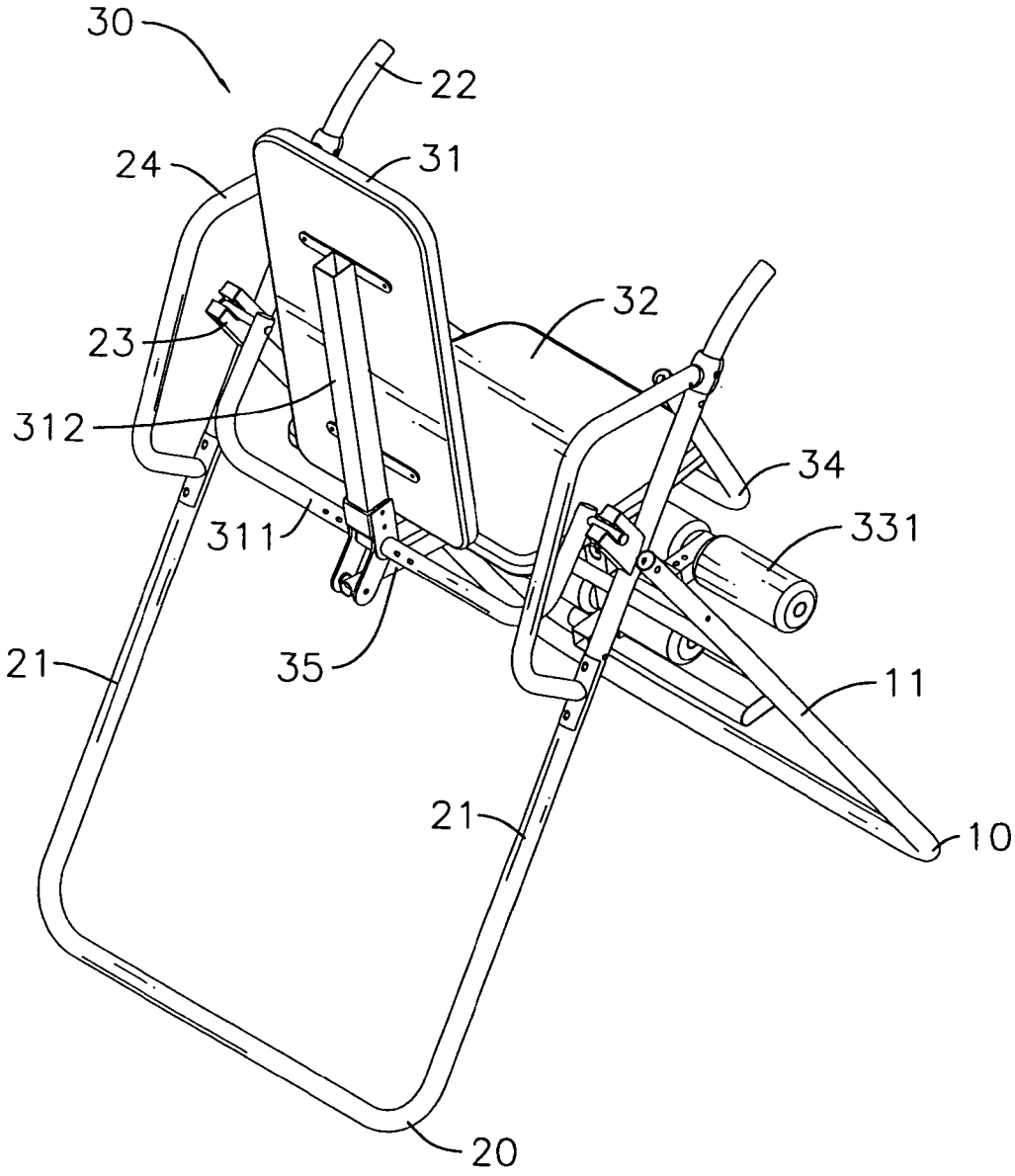
FIG. 2 is another perspective view of the exercising apparatus in FIG. 1.

With reference to FIGS. 1 and 2, an exercising apparatus in accordance with the present invention comprises a front frame (10), a rear frame (20) and a seat assembly (30).

The front frame (10) has a bottom rod, two supporting rods (11), a connecting rod (12) and a damper (13). The bottom rod has two ends and the supporting rods (11) are mounted respectively on the ends of the bottom rod. The connecting rod (12) is mounted between the supporting rods (11). The damper (13) is mounted on the connecting rod (12).

The rear frame (20) is connected to the front frame (10) and has a bottom rod, two supporting rods (21), two handles (22), two hanging members (23) and two handgrips (24). The bottom rod has two ends and the supporting rods (21) are mounted respectively on the ends of the bottom rod. The supporting rods (21) each have an upper end, and the handles (22) are mounted respectively on the upper ends of the supporting rods (21). The hanging members (23) are mounted respectively on the supporting rods (21) and each have an open slot. The handgrips (24) are mounted respectively on the supporting rods (21).

Figure 3:
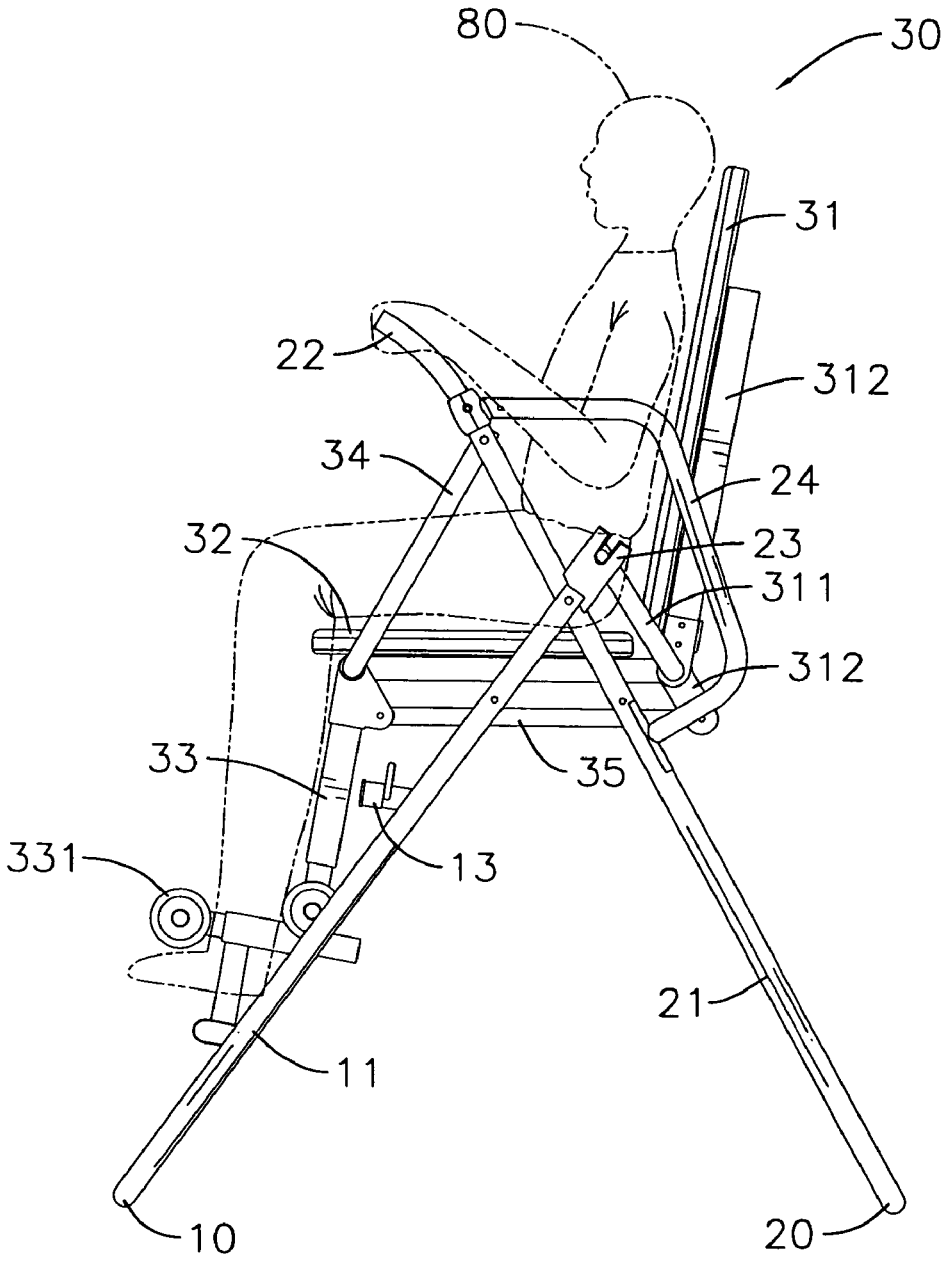
FIG. 3 is an operational perspective view of the exercising apparatus in FIG. 1.

With further reference to FIG. 3, the seat assembly (30) is mounted pivotally between the front frame (10) and the rear frame (20) and has a seat back (31), a seat (32), a leg holder (33), a front connecting rod (34) and a lower connecting rod (35). The seat back (31) is mounted pivotally between the hanging members (23) and has a rear side, a connecting post (312), and a U-shaped connector (311). The connecting post (312) is mounted on and protruded downward from the rear side of the seat back (31) and has a lower end. The U-shaped connector (311) is mounted on the lower end of the connecting post (312) and has two ends. The ends of the U-shaped connector (311) are mounted pivotally and respectively in the open slots of the hanging members (23).

The seat (32) is connected pivotally to the lower end of the connecting post (312) of the seat back (31) and has a front end. The leg holder (33) is connected pivotally to the front end of the seat (32), aligns with the damper (13) and has a lower end and two holding bars (331). When the leg holder (33) pivots rearward and abuts the damper (13), the impulse of the leg holder (33) can be effectively absorbed by the damper (13). The holding bars (331) are mounted on the lower end of the leg holder (33) for holding the user's ankles. The holding bars (331) each have an optional sponge sleeve mounted around the holding bar (331).

The front connecting rod (34) is U-shaped and has a bottom rod and two side rods. The bottom rod is mounted pivotally on the front end of the seat (32) and has two ends. The side rods each have a proximal end and a distal end. The proximal end is connected to one end of the bottom rod and the distal end is mounted pivotally on the supporting rod (21) of the rear frame (20).

The lower connecting rod (35) has a front end and a rear end. The front end is connected pivotally to the leg holder (33) and the rear end is connected pivotally to the lower end of the connecting post (312).

Figure 4:
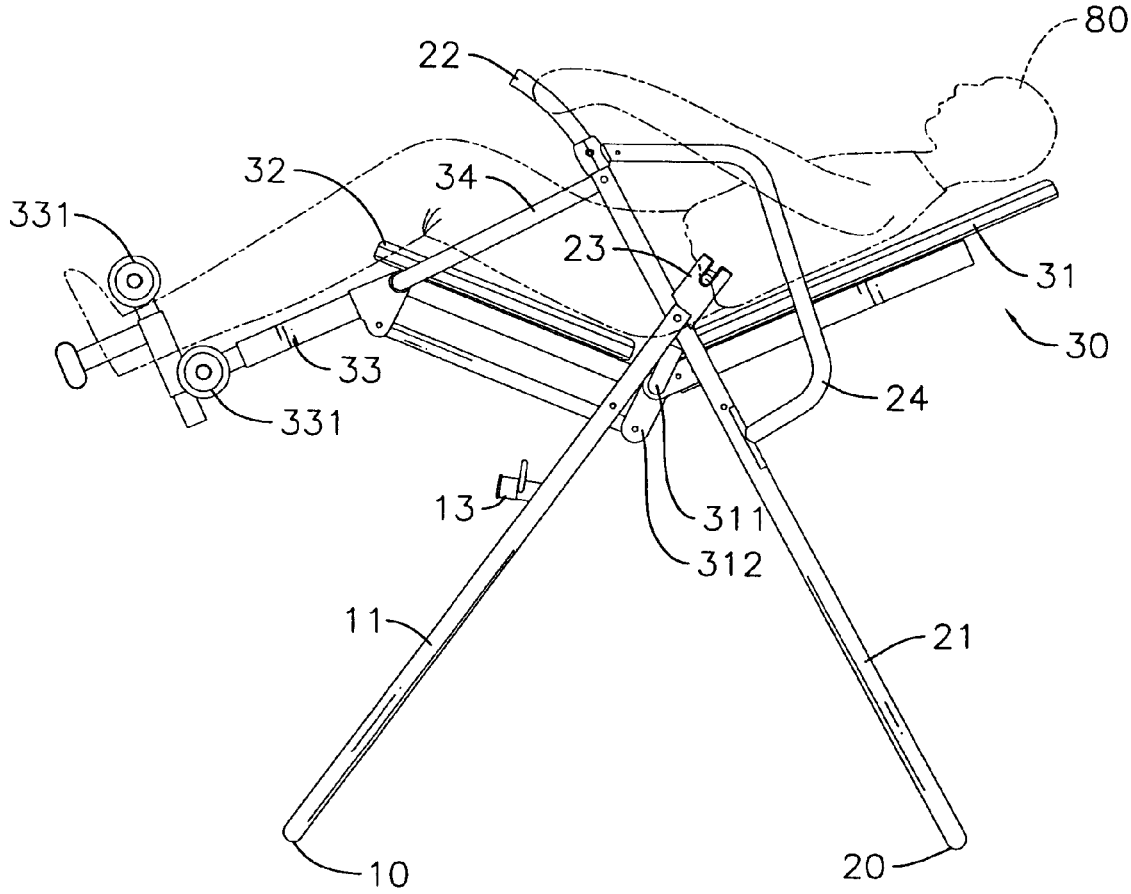
FIG. 4 is an operational perspective view of the exercising apparatus continued from FIG. 3.
Figure 5:
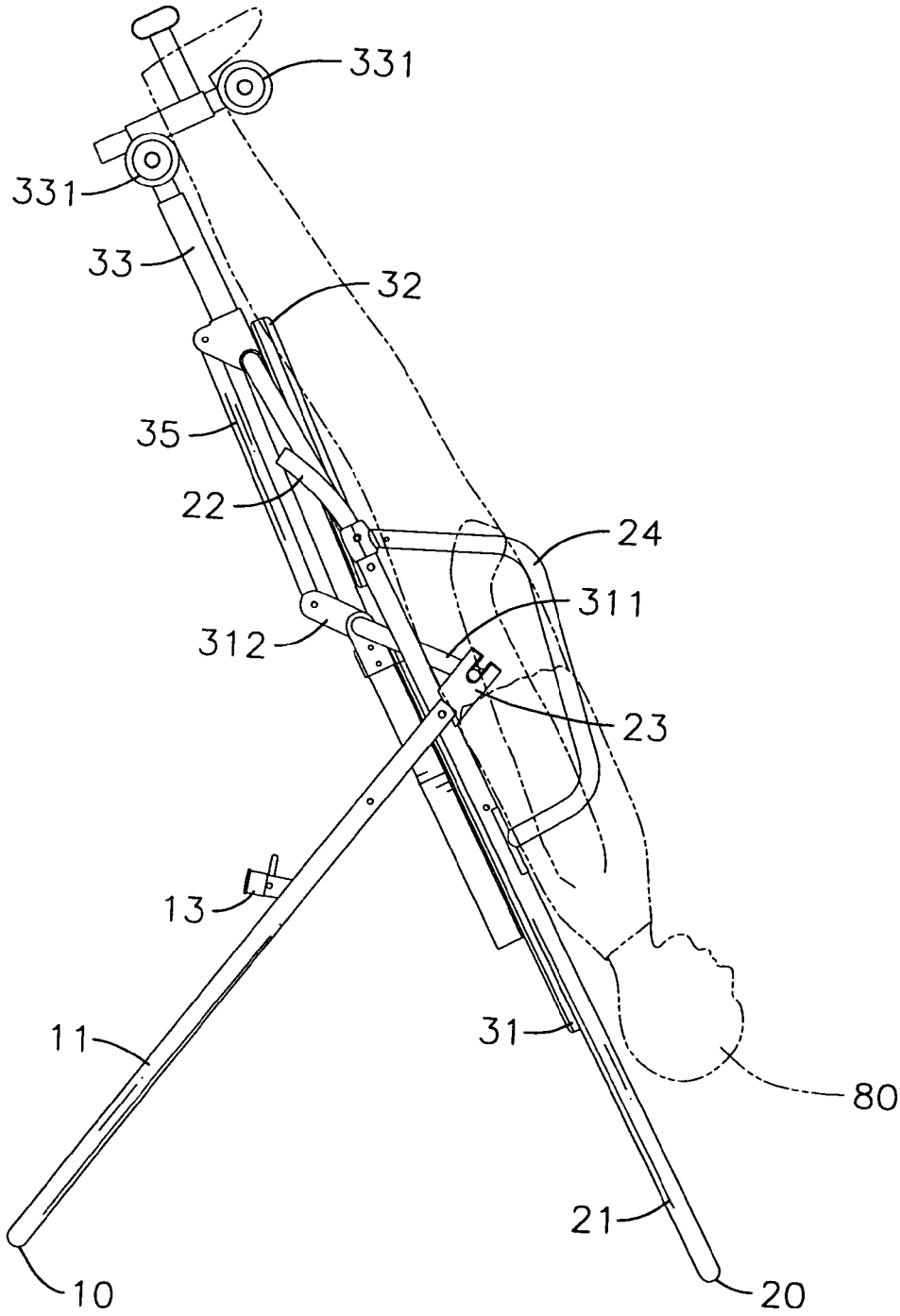
FIG. 5 is an operational perspective view of the exercising apparatus continued from FIG. 4.

In use, the user sits on the seat assembly (30) and holds the handles (22) of the rear frame (20) with hands and the holding bars (331) with legs. With further reference to FIGS. 4 and 5, when the user is inverting, the seat back (31) and the seat (32) are pivoted relative to the rear frame (20) and the hanging members (23). Hands of the user hold the handles (22) and gradually move to the handgrips (24) for keeping balance. The angle between the seat back (31) and the seat (32) is increasing during the pivotal rotation of the seat assembly (30). At this time, the user's abdominal muscles are extended and dorsal muscles are contracted so an exercising effect to the torso muscles is achieved. In addition, the angle change between the seat (32) and the leg holder (33) also provides an exercising effect to the user's femoral muscle.

Figure 6:
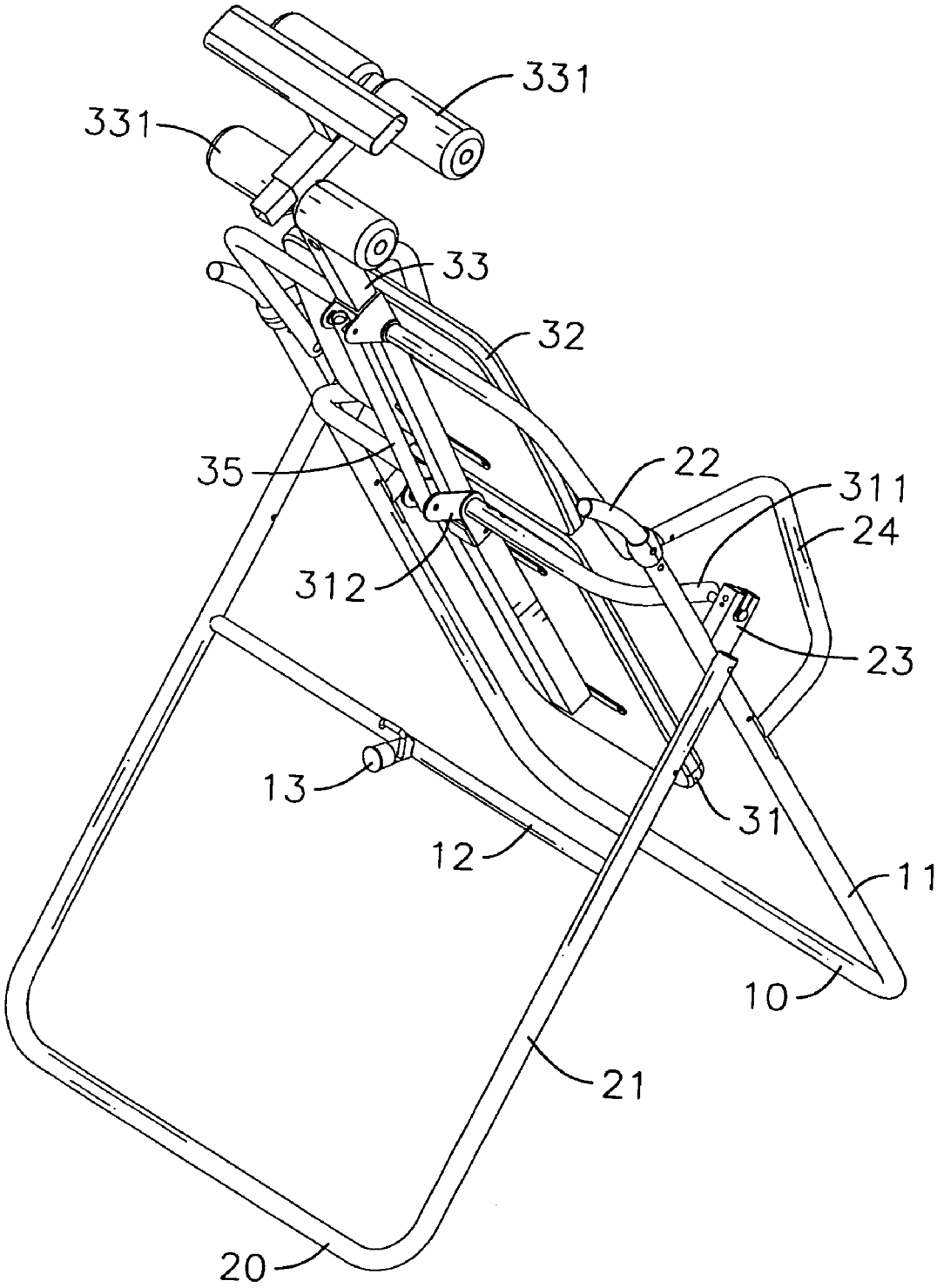
FIG. 6 is a perspective view of the exercising apparatus in FIG. 5.

With further reference to FIGS. 5 and 6, when the user is in an inverted position, the seat back (31), seat (32) and leg holder (33) are in alignment with each other. The user's body is inverted and stretched so pressure of body weight on the spine can be eliminated. The back pain caused by the pressure can be eased by the inversion condition.

Furthermore, with the relative movement between the seat back (31) and the seat (32) and the relative movement between the seat (32) and the leg holder (33), the torso and femoral muscles of the user can be fully exercised. Therefore, the exercising apparatus in accordance with the present invention has multiple functions of inverting the user to release the pressure on the spine and exercising the torso and femoral muscles of the user.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. An exercising apparatus comprising:

a front frame having a damper being mounted on the front frame;

a rear frame being connected to the front frame and having two hanging members being mounted on the rear frame; and two handgrips being mounted on the rear frame; and a seat assembly being mounted pivotally between the front frame and the rear frame and having a seat back being connected pivotally between the hanging members and having a lower end;

a seat being connected pivotally to the lower end of the seat back and having a front end;

a leg holder being mounted pivotally on the front end of the seat, aligning with the damper and having a lower end; and two holding bars being mounted on the lower end of the leg holder;

a front connected rod being mounted pivotally on the front end of the seat and having two ends pivotally connected to the rear frame; and a lower connecting rod having a front end being connected pivotally to the leg holder; and a rear end being connected pivotally to the lower end of the seat back.

2. The exercising apparatus as claimed in claim 1, wherein the front frame further comprises a bottom rod having two ends;

two supporting rods being mounted respectively on the ends of the bottom rod; and a connecting rod being mounted between the supporting rods; and the damper is mounted on the connecting rod.

3. The exercising apparatus as claimed in claim 2, wherein the rear frame further comprises a bottom rod having two ends;

two supporting rods being mounted respectively on the ends of the bottom rod and each having an upper end; and two handles being mounted respectively on the upper ends of the supporting rods; and the hanging members are mounted respectively on the supporting rods of the rear frame and each have an open slot; and the handgrips are mounted respectively on the supporting rods of the rear frame.

4. The exercising apparatus as claimed in claim 3, wherein the seat back of the seat assembly further comprises a rear side;

a connecting post being mounted on and protruded downward from the rear side of the seat back and having a lower end; and the lower connecting rod has a front end being connected pivotally to the leg holder; and a rear end being connected pivotally to the lower end of the connecting post.

5. The exercising apparatus as claimed in claim 4, wherein the seat back of the seat assembly further comprises a U-shaped connector being connected to the lower end of the connecting post and having two ends connected pivotally and respectively to the open slots of the hanging members.

6. The exercising apparatus as claimed in claim 5, wherein the front connecting rod of the seat assembly is U-shaped and further comprises a bottom rod being mounted pivotally on the front end of the seat and having two ends; and two side rods having a proximal end being connected to one end of the bottom rod of the front connecting rod; and a distal end being mounted pivotally on one of the supporting rods of the rear frame.

7. The exercising apparatus as claimed in claim 1, wherein the rear frame further comprises a bottom rod having two ends;

two supporting rods being mounted respectively on the ends of the bottom rod and each having an upper end; and two handles being mounted respectively on the upper ends of the supporting rods; and the hanging members are mounted respectively on the supporting rods of the rear frame and each have an open slot; and the handgrips are mounted respectively on the supporting rods of the rear frame.

8. The exercising apparatus as claimed in claim 1, wherein the seat back of the seat assembly further comprises a rear side;

a connecting post being mounted on and protruded downward from the rear side of the seat back and having a lower end; and the lower connecting rod has a front end being connected pivotally to the leg holder; and a rear end being connected pivotally to the lower end of the connecting post.

9. The exercising apparatus as claimed in claim 3, wherein the front connecting rod of the seat assembler is U-shaped and further comprises a bottom rod being mounted pivotally on the front end of the seat and having two ends; and two side rods having a proximal end being connected to one end of the bottom rod of the front connecting rod; and a distal end being mounted pivotally on one of the supporting rods of the rear frame.

* * * * *